United States Patent [19]

Hyöty et al.

[11] Patent Number: 4,891,097

[45] Date of Patent: Jan. 2, 1990

[54] METHOD FOR REGULATING, THE FEEDING-IN OR COMBUSTION CONDITIONS OF CONCENTRATED SPENT LIQUORS

[75] Inventors: Paavo Hyöty; Erik Uppstu; Erik Saiha, all of Tampere, Finland

[73] Assignee: Oy Tampella AB, Tampere, Finland

[21] Appl. No.: 129,863

[22] Filed: Dec. 4, 1987

Related U.S. Application Data

[63] Continuation of Ser. No. 839,622, Mar. 14, 1986, abandoned.

[30] Foreign Application Priority Data

Mar. 18, 1985 [FI] Finland ..... 851071

[51] Int. Cl.[4] ..... D21C 7/12; D21C 11/12

[52] U.S. Cl. ..... 162/31; 162/301; 162/36; 162/49; 162/DIG. 10; 110/187; 110/238

[58] Field of Search ..... 162/30.1, 30.11, 31, 162/36, 33, 49, DIG. 10; 110/238, 187

[56] References Cited

U.S. PATENT DOCUMENTS 4,042,328 8/1977 Seymour ..... 162/49

4,498,955 2/1985 Nelson ..... 162/49 X

*Primary Examiner*—Peter Chin

*Assistant Examiner*—Thi Dang

*Attorney, Agent, or Firm*—Cushman, Darby & Cushman

[57] ABSTRACT

The invention relates to a method of regulating, for the purpose of burning soda-ash in a recovery boiler furnace, the feeding-in or combustion conditions of concentrated spent liquors of varying chemical and physical properties by measuring some physical property of a liquor fed into the recovery boiler furnace and by regulating the feeding-in and combustion conditions directly on the basis of the thus measured physical properties. According to the invention, the maximum swelling, upon heating, of a dry-matter particle of the liquor fed into the recovery boiler furnace is measured. On the basis of this measurement the temperature, pH value, or injection pressure of the liquor fed into the furnace, or the height of the injection point or the direction of injection, or the feeding of air into the furnace is adjusted directly on the basis of the maximum swelling measurement.

1 Claim, 2 Drawing Sheets

METHOD FOR REGULATING, THE FEEDING-IN OR COMBUSTION CONDITIONS OF CONCENTRATED SPENT LIQUORS

This is a continuation of application Ser. No. 839,622, filed Mar. 14, 1986 which was abandoned upon the filing hereof.

BACKGROUND OF THE INVENTION

1. Field of the Invention

The present invention relates to a method for regulating, for the purpose of burning in a recovery boiler furnace for soda-ash, the feeding-in and/or combustion conditions of concentrated spent liquors of varying chemical and physical composition by measuring some physical property of the liquor to be fed into the soda-ash furnace and by regulating the feeding-in and/or combustion conditions directly on the basis of the property thus measured.

This invention relates in particular to a method for regulating, for the purpose of burning in the recovery boiler furnace, the feeding-in and/or combustion conditions of liquor mixtures which contain, in varying proportions, liquors derived from both sulfate and sulfite digestion processes.

2. Description of the Related Art

As is known, spent cooking liquor is produced in pulp digestion, and for the economy of pulp production it is very important that the heat content and chemicals of this spent liquor are recovered as carefully as possible for reuse in the pulping process. Before the spent liquor is burned in order to release the thermal energy and to recover the chemicals, water is evaporated out from the liquor to produce a liquor which contains about 40% water; this concentrated liquor is burned in the recovery boiler furnace and the thermal energy thereby released can be used in the pulping process, and the chemicals can be recovered from the bottom of the furnace and, after regeneration, can be used for the preparation of new cooking liquor.

As energy prices have risen continually, it has become increasingly important for the economy of the pulping process that the burning of liquor in the recovery boiler furnace is as disturbance-free as possible in order to achieve good chemical economy, low emissions, high energy efficiency, and good process economy.

For the primary function of the recovery boiler furnace, i.e. the recovery and regeneration of inorganic chemicals for the preparation of cooking liquor, it is necessary to create in the lower part of the soda-ash furnace a reducing section having a high temperature and a so-called char bed at its bottom. The degree of regeneration in the furnace is measured in terms of sulfur reduction degree.

The recovery of the chemicals is measured in terms of loss of chemicals. Losses are incurred when gases such as $SO_2$ are emitted from the process along with flue gases.

Another function of the recovery boiler furnace is to recover heat from the flue gases. The effectiveness of this recovery can be measured in terms of the flue gas losses, the proportion of unburnt gases, and the usability of the furnace, for example, in terms of stoppages due to the fouling of the heating surfaces.

The operation of the recovery boiler furnace is affected by many factors. The concentrated spent liquor fed into the furnace still contains a relatively high amount of water (about 40%). This water amount must be caused to evaporate in the furnace, and the evaporation must take place substantially from the liquor droplet falling towards the char bed at the bottom of the soda-ash furnace, before the droplet reaches the surface of the char bed. If this does not happen, a large proportion of the water must be evaporated from the surface of the char bed, which of course decreases the temperature of the char bed and, in turn, increases the emission of sulfur dioxide and decreases the reduction degree.

If water has evaporated before the droplets reach the char bed, the droplets become so light in weight that they may be captured by the gas flow rising in the furnace, whereupon they are pyrolyzed and burned in suspension (flow), consequently increasing the dust load in the gas flow. The aim is to make the size of the liquor droplets in the furnace such that the dry matter content is suitable at the time the droplet hits the surface of the char bed and that the remaining small amount of water evaporates rapidly from the surface of the char bed and produces a porous char bed. Thereby the char bed at the bottom of the furnace remains hot, making it possible to maintain good chemical economy and good usability of the furnace.

Droplet size suitable in terms of the operation of the recovery boiler furnace has been determined visually on the basis of experience, for example by observing the temperature of the char bed, at the bottom of the recovery boiler furnace on the basis of, for example, color or by measuring. It has been noted that it is the viscosity of the liquor fed into the furnace that primarily determines the size of the droplets formed in the gas space of the recovery boiler furnace when, for example, the size and type of the nozzles feeding liquor into the furnace, as well as the feeding pressure, remain substantially constant. Respectively, when the viscosity is constant, the droplet size is determined by the nozzle diameter at a constant flow of liquor.

In order to maintain the droplets at the size experimentally found to be good in the above-mentioned manner, the quantity used as the control parameter has been the dry-matter content of the concentrated liquor, determined by means of its density or by using a refractometer, and the changes to be affected in the temperature and the injection pressure of the liquor fed into the furnace in order to obtain droplets of the desired size in the gas space of the furnace have been determined on the basis of the measurement. In the main, the viscosity of the liquor has been regulated by heating the liquor. Such regulation is described in the publication Pulp and Paper 53, (1979), pp. 142–145.

Aerometric measuring is commonly used for measuring the density. The raw material and the cooking conditions remaining constant, dry-matter measuring by means of a refractometer yields a quantity which can be used for the control of the recovery boiler furnace.

Disturbance-free operation of the recovery boiler furnace was achieved previously by maintaining the preparation process and, consequently, the properties of the concentrated liquor as even as possible, and owing to this it was possible to operate the burning process at a constant setting. Previously, pulp mills used in general one single type of wood in each mill, and, likewise, usually one single specific pulp type was produced, and, as a result, the chemical composition of the spent liquor remained more or less unchanged.

The operation of the evaporation plant was adjusted in such a way that a certain maximally constant dry-matter content was reached, and the burning process was adjusted according to this content. Efforts were made to regulate the dry-matter content with a precision of about ±1.5 percentage points. If fluctuations are great, they reflect in the operation of the recovery boiler furnace, causing changes in the degree of reduction, $SO_2$ gas emission, and fouling of the furnace. Whenever difficulties have appeared, the operator of the recovery boiler furnace has requested that a check be made whether the process parameters in the evaporation plant and in the digestor have remained within the set range.

Fluctuations in the chemical composition of the liquor to be burned are caused by increasingly closed processes, i.e. closed chemical cycles. Variations in the raw materials also require new digester parameters, a factor which complicates the operation of the evaporation plant. Furthermore, the liquors of an increasing number of cooking processes are burned in one and the same furnace. Under these circumstances the properties of the liquor cannot be maintained as constant as previously.

When mixtures of parallel cooking liquors are burned and when other waste materials are added to the liquor to be burned, the disturbance is shifted directly to the recovery boiler furnace.

In addition the above-mentioned major disturbances at the recovery boiler furnace, the overall quality standards set for the equipment have risen. There is a high requirement for usability under varying conditions, while the $SO_2$ level in the flue gases and the degree of reduction in the smelt must be at controlled levels.

The feeding into the recovery boiler furnace of concentrated spent liquors of varying chemical and physical composition so as to produce a suitable droplet size in the furnace has been regulated by adjusting the feeding-in conditions of the liquor being fed into the recovery boiler furnace, not only on the basis of the above-mentioned dry solids content measured from the concentrated spent liquor but alternatively also on the basis of a viscosity value measured directly from the liquor fed into the recovery boiler furnace. Using viscosity measurements as the control quantity for the feeding in of liquor is a much more rapid and more simple method then regulating the recovery boiler furnace on the basis of a dry solids analysis. On the basis of viscosity measurements it is possible to adjust the feeding-in conditions rapidly to such values that the liquor discharged through the nozzles forms droplets of the desired size.

It has, however, now been observed that, although on the basis of viscosity measurements it is possible to adjust the feeding-in conditions to such values that the liquor discharging from the nozzles can be caused to form droplets of the desired size, it is not possible on the basis of this viscosity measurement to determine how the liquor droplets thus formed behaves while falling in the furnace space towards the surface of the char bed at the bottom of the furnace. It has been observed that a change in the chemical or physical composition of the liquor may cause a change in its combustion behavior in the recovery boiler furnace even if the viscosity of the liquor, and thereby the size of the droplet formed by the liquor discharging from the nozzle, remains the same. From this it has been concluded that some unforeseen factor influences the combustion behavior of the liquor drop falling in the gas space in the recovery boiler furnace, in which case the above-mentioned methods of measuring are not sufficient for regulating the size of the liquor droplet formed in the gas space of the recovery boiler furnace when the chemical and physical properties of the dry matter in the liquor being fed into the furnace vary, for example because the type of wood or the method used in the pulping process, or the batching and additions of chemicals have been changed.

SUMMARY OF THE INVENTION

The object of the present invention is thus to provide a method for regulating, for the purpose of burning in the recovery boiler furnace, the feeding-in and/or combustion conditions of concentrated spent liquors of varying chemical and physical composition by measuring some physical property of the liquor being fed into the furnace, on the basis of which measurement the feeding-in and combustion conditions can be directly regulated so that also the behavior of the liquor droplet, after it has been formed and while it is falling in the gas space of the furnace, is taken into account. The object of the present invention is therefore to provide a method for regulating, for the purpose of burning in the recovery boiler furnace, the feeding-in and/or combustion conditions of concentrated spent liquors of varying chemical and physical composition, a method by means of which in the furnace of the liquor is caused to form droplets the size of which is more suitable than previously for the burning of the liquor.

In the research which led to the present invention it was surprisingly observed that the properties of the liquor have a crucial effect on the swelling of the dry matter contained in the liquor droplet in the furnace. An investigation of the properties and behavior of liquor droplets in the furnace showed that the swelling properties of the solid dry matter remaining in the liquor droplet after the evaporation of the liquid have a significant effect on the burning of the liquor in the furnace. The expansion of a dry-matter particle of the liquor affects its falling speed and the quality of the char bed at the bottom of the furnace. It has been observed that the more the liquor expands the greater the size of the droplets formed must be in order that the falling speed of the liquor droplet remain correct for the combustion. In this case the unexpanded droplet has a sufficient time to dry and to burn while it descends to the bottom of the furnace, and the char bed will not become moist and will not grow in an uncontrolled manner owing to its compaction. When the quality of the liquor changes the swelling properties of its solid matter usually also change, and by the method according to the present invention this change in the swelling can be taken into account and be compensated for by adjusting either the feeding-in conditions of the liquor or its combustion conditions in the recovery boiler furnace, or both simultaneously.

According to the present invention, the maximum swelling, upon heating, of the dry-matter particle of the liquor fed into the recovery boiler furnace is measured, and the feeding-in and/or combustion conditions are adjusted directly on the basis of the maximum swelling measurement.

The feeding-in conditions can be adjusted on the basis of the maximum swelling measurement, by adjusting either the chemical or the physical properties of the concentrated liquor. The chemical properties of the concentrated spent liquor can be regulated by adjusting the pH value or the mixing ratio of the liquor, by oxidation, or by the addition of additives. The physical properties of the liquor, for their part, can be regulated by heating or cooling the liquor in order to change its viscosity. The feeding-in conditions can also be regulated by adjusting the feeding-in pressure of the liquor being fed into the recovery boiler furnace, or the size of the feeding nozzles and/or their height from the bottom of the furnace, which affects the time a liquor droplet takes to fall in the furnace.

Alternatively, or additionally, the combustion conditions in the recovery boiler furnace can be adjusted on the basis of the maximum swelling measurement, by adjusting the distribution of the primary and secondary air fed into the furnace.

Overall, it can be said that the change in the swelling of the liquor is compensated for by some other change affecting the burning of the liquor, and in practice this other change is realized by investigating in advance how the swelling of the liquor affects its burning in the furnace under different conditions and, for example, a computer program is prepared on the basis of this investigation. When information on some chemical or physical property of the liquor, e.g. the ratio at which liquors have been mixed or the pH value of the liquor, is fed into a computer thus programmed, the computer will indicate, on the basis of the maximum swelling measurement data programmed into it, how the feeding-in or combustion conditions in the recovery boiler furnace are to be changed in order to compensate for the change which has occurred in the chemical or physical properties of the liquor.

BRIEF DESCRIPTION OF THE DRAWINGS

The invention is described below in greater detail with reference to the accompanying drawings.

DETAILED DESCRIPTION OF THE PREFERRED EMBODIMENTS

Figure 1:
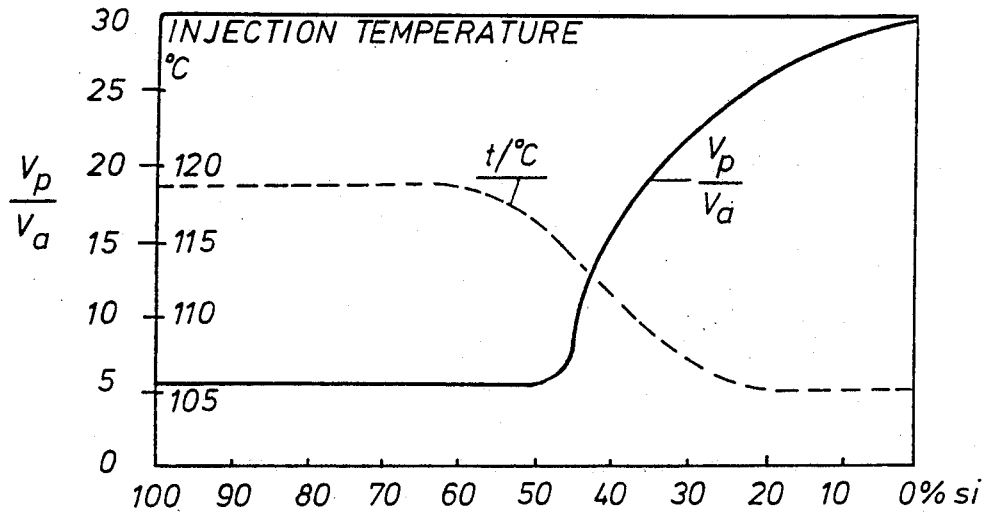
FIG. 1 depicts the effect of the sulfite/sulfate mixing ratio on the maximum swelling of the liquor as a function of the sulfite content, and the injection temperature at the nozzle, typical of each maximum swelling value.

FIG. 1 shows the change in swelling, detected by laboratory measurements, in the case of two liquor types, i.e. sulfite and sulfate liquor. $V_p$ indicates the volume of an expanded dry-matter particle formed from a droplet, and $V_a$ indicates the volume of the original liquor droplet. The x-axis represents the sulfite content of the liquor mixture as percentages, the balance being sulfate liquor. At a certain mixing ratio, which is dependent on, for example, the type of the liquor resulting from, for example, the cooking method and the operation of the mill, the expansion changes sharply, and this change has a strong effect on the burning of the liquor in the recovery boiler furnace, unless compensating adjustment is carried out. The control is calibrated on the basis of the dotted curve shown in FIG. 1; the curve depicts the temperature of the mixture, measured at the nozzle in given conditions, as a function of the sulfite/-sulfate mixing ratio.

Figure 2:
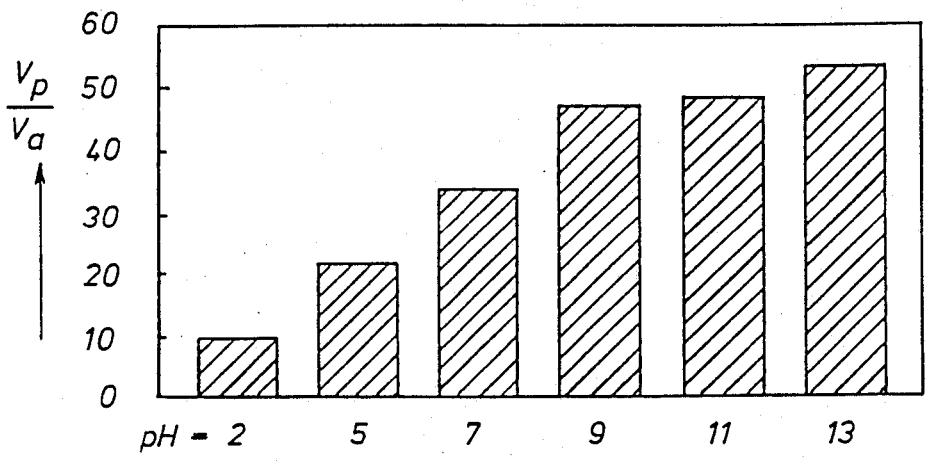
FIG. 2 depicts the maximum swelling of pine sulfate liquor as a function of the pH.

FIG. 2 depicts the swelling of the liquor as a function of its pH. The pH of the liquor is measured at at least one point of the liquor line to implement the control.

Figure 3:
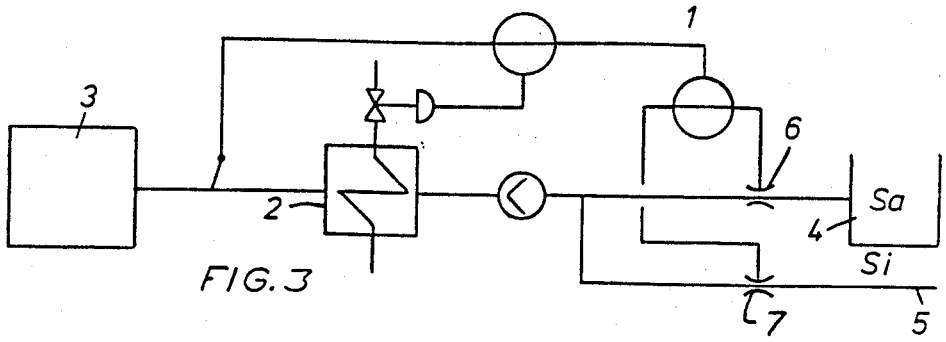
FIG. 3 depicts a typical flow and control chart for the carrying out of the method according to the present invention when burning a sulfate/sulfite mixture.

FIG. 3 depicts the apparatus by means of which the injection of liquor into the recovery boiler furnace 3 is regulated on the basis of the mixing ratio of two different types of liquor. Sulfate liquor is directed from container 4 and sulfite liquor from pipe 5 and fed as a mixture through the preheater 2 and from there further into the recovery boiler furnace 3. The preheater 2 for the liquor, and thereby the droplet formation, in order to take expansion into account in the injection, is controlled by means of a measuring and control circuit 1, which measures the flow of the sulfate liquor at point 6 and the flow of the sulfite liquor at point 7, thus regulating the preheater 2 on the basis of these measurements.

Figure 4:
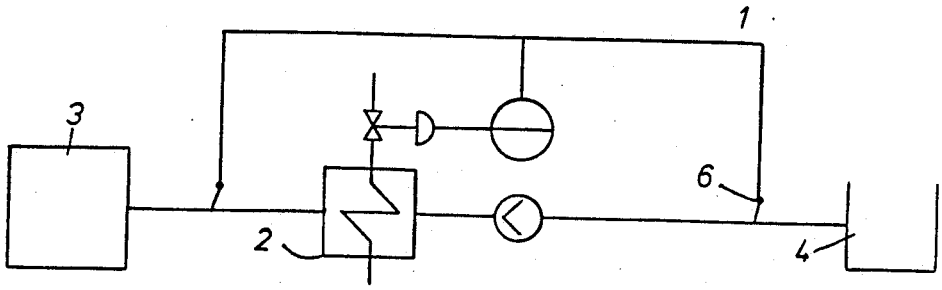
FIG. 4 depicts one alternative control and flow chart, in which the pH of the liquor to be burned varies.

In the embodiment depicted in FIG. 4, the corresponding control of the preheater 2 is carried out on the basis of the pH measurement at point 6 of the liquor flow coming from the container 4, which pH is dependent on the amount of residual alkali in the liquor.

When, in accordance with the present invention, one or more of these physical properties of concentrated spent liquor which affect the swelling of the droplet is/are used directly as the control parameter, the fluctuation of the chemical composition and/or the physical properties of the liquor does not disturb the evenness of the burning process in the recovery boiler furnace. According to the present invention, the burning in the furnace can thus be regulated on the basis of a measurement made directly on the liquor or on the basis of the mixing ratio of the liquor mixture by using the swelling of the liquor or the liquors as the calibration parameter.

The maximum expansion of the liquor can be measured for example by photographing the expansion of a droplet in a laboratory furnace, and by measuring the ratios of the droplet diameters from the photographs, by measuring the combustion times of droplets of a certain size in a furnace having a constant temperature, in which case the combustion time is directly proportional to the maximum swelling, or in some other suitable manner.

We claim:

1. A method for providing feedback control for maximizing soda-ash output of a recovery boiler furnace for soda-ash, in which droplets of at least one spent digesting liquor from at least one sulfite-type or sulfate-type wood pulp digester are sprayed so as to fall through a combustion zone, thus being dried and burned to form solid particles, and in being dried or burned, undergo an expansion of a variable amount, (a) establishing in a computer a body of data correlating droplet-to-particle expansion with a variable parameter which can be monitored while conducting said method;

(b) monitoring said variable parameter for variations, while conducting said method, to provide results and providing said results to said computer;

(c) comparing said results with said body of data in said computer to provide a feedback control output; and (d) providing the feedback control output to an equipment controller for automatically increasing and decreasing the size of droplets sprayed into said furnace to be dried and burned, depending on said feedback control output so as to smoothout variations in said soda-ash output, said variable parameter being one selected from the group consisting of the pH of said spent liquor and the ratio of spent sulfite liquor to spent sulfate liquor in said spent liquor.

* * * * *